US006508609B2

(12) United States Patent
Knight et al.

(10) Patent No.: US 6,508,609 B2
(45) Date of Patent: Jan. 21, 2003

(54) METHOD OF FORMING AN IN-SITU VOID SYSTEM

(76) Inventors: David W. Knight, P.O. Box 2586, Humble, TX (US) 77347; Shelby Meadows, P.O. Box 916, Bellville, TX (US) 77418

( * ) Notice: Subject to any disclaimer, the term of this patent is extended or adjusted under 35 U.S.C. 154(b) by 0 days.

(21) Appl. No.: 09/828,051

(22) Filed: Apr. 9, 2001

(65) Prior Publication Data

US 2002/0146288 A1 Oct. 10, 2002

(51) Int. Cl.[7] ..... E02D 1/00; E02D 3/12

(52) U.S. Cl. ..... 405/229; 405/263; 405/233; 52/169.9

(58) Field of Search ..... 405/50, 229, 231, 405/232, 233, 250, 263, 204, 266; 52/169.14, 169.9

(56) References Cited

U.S. PATENT DOCUMENTS 2,219,710 A * 10/1940 Litz et al. ..... 405/229
3,274,783 A * 9/1966 Handy ..... 405/266
3,602,248 A * 8/1971 Peacock ..... 52/169.14
3,667,236 A * 6/1972 Rosene ..... 405/50
4,380,408 A * 4/1983 Loken et al. ..... 405/263
4,494,694 A * 1/1985 Pitt et al. ..... 405/266
4,508,472 A * 4/1985 Handy et al. ..... 405/229
4,832,533 A * 5/1989 Ringesten ..... 405/233
5,228,808 A * 7/1993 McKennon et al. ..... 405/266

* cited by examiner

*Primary Examiner*—Frederick L. Lagman
(74) *Attorney, Agent, or Firm*—Harrison & Egbert

(57) ABSTRACT

A method of forming an in-situ void system including the steps of determining an expansion potential of soil adjacent to a structure and forming an array of voids in an area adjacent to the structure so as to accommodate the expansion potential of the soil. The array of voids is formed by drilling an array of holes beneath the structure or around a perimeter of the structure. The holes are drilled to a depth of the expansion potential. A liquid can be introduced into the voids so as to swell the soil. The top of the array of voids is covered prior to laying the foundation over the array of voids.

8 Claims, 2 Drawing Sheets

METHOD OF FORMING AN IN-SITU VOID SYSTEM

BACKGROUND OF THE INVENTION

1. Field of the Invention

The present invention relates to methods for preventing soil expansion from affecting the structure of a building. More particularly, the present invention relates to in-situ void systems that are used to accommodate soil expansion in areas adjacent to the foundation of a structure.

2. Description of Related Art

There are several methods commonly utilized prior to construction to prevent highly expansive soils from damaging structures that are either supported or contained within the earth. These methods can be divided into void systems and soil treatments. The void systems utilize forms to create a void beneath or adjacent to a structure so as to allow for expansion of soils without damage to the structure. The soil treatment includes either water or chemical treatments prior to construction for the purpose of reducing the potential of the soil to expand and damage the structure.

Although these methods are useful, they have certain disadvantages. The void systems can be divided into cardboard void forms and low density EPS void forms. These two are the most commonly accepted methods for reducing the potentially damaging effects of expanding soils. However, due to their high cost, they are typically only used at perimeter locations, rather than throughout the full foundation area. Also, the cardboard forms have the added disadvantage of serving as a reservoir for water to sit adjacent to areas not having voids. As such, this will create a situation whereby the adjacent area is damaged due to expanding soil. Likewise, the EPS void systems have the added disadvantage of not being fully compressible and thereby not alleviating as much expansion as might be necessary to avoid damage. The EPS void system is otherwise known as a STYROFOAM (TM) void form.

The water and chemical treatments are also costly and have the added disadvantage of being difficult to verify proper application. These systems are subject to significant operator error during the treatment. As a result, a customer may pay for the treatment and effectively gain no significant reduction in the potential for damage from the soils that were so treated. Additionally, the various types of nozzles employed for such water and chemical treatments often become clogged or damaged when placed into the earth. The soil in the proximity of the nozzle will often clog the nozzle so that the proper amounts of water and chemicals are not delivered from the nozzle. Methods for conditioning soil after construction, in order to minimize or reduce damage from expanding soils, are not available in the current art.

It is an object of the present invention to provide a void system which minimizes soil expansion.

It is another object of the present invention to provide a void system which minimizes structural damage to a building or a foundation.

It is still another object of the present invention to provide a void system which effectively absorbs any expansion of the soil.

It is a further object of the present invention to provide a void system which reduces soil expansion potential against the walls of the structure.

It is a further object of the present invention to provide a void system that can be applied to either existing structures or prior to the formation of the structure.

It is still another object of the present invention to provide a void system that effectively maintains the structural integrity of foundations and basements.

It is still another object of the present invention to provide a void system which is easy to use, relatively inexpensive and easy to implement.

These and other objects and advantages of the present invention will become apparent from a reading of the attached specification and appended claims.

BRIEF SUMMARY OF THE INVENTION

The present invention is a method of forming an in-situ void system comprising the steps of: (1) determining an expansion potential of the soil adjacent to a structure; and (2) forming an array of voids in an area adjacent to the structure so as to accommodate the expansion potential of the soil. The step of forming the array of voids can be carried out by drilling an array of holes beneath the structure. This array of holes can be drilled to a depth of the soil potential. Alternatively, the array of holes can be drilled around a perimeter of the structure.

In the present invention, a liquid can be introduced into the array of voids so as to swell the soil. The liquid can be either water or a mixture of water and lime. When lime is used, the lime will react with the minerals within the clay so as to stabilize the clay in the soil.

In the present invention, the structure can be the foundation of the building. When the structure is the foundation of the building, the method of the present invention also includes laying the foundation over the array of voids subsequent to the step of forming the array of voids. The top of the array of voids is covered with a material prior to laying the foundation. This material can either be a rigid plastic sheet having a structural integrity suitable for withstanding the weight of the foundation or it can be a fill soil interposed between the top of the array of voids and the bottom of the foundation.

When the structure of the present invention is an existing structure, the step of forming the array of voids can include drilling an array of holes around a perimeter of the existing structure to a depth at least as deep as the existing structure within the soil.

Within the concept of the present invention, the holes can be drilled vertically or horizontally. The array can be either geometrically regular or geometrically irregular. The array of voids can be a grid of trenches formed in a soil matrix. These trenches can be either vertical, horizontal or any orientation therebetween.

DETAILED DESCRIPTION OF THE INVENTION

Figure 1:
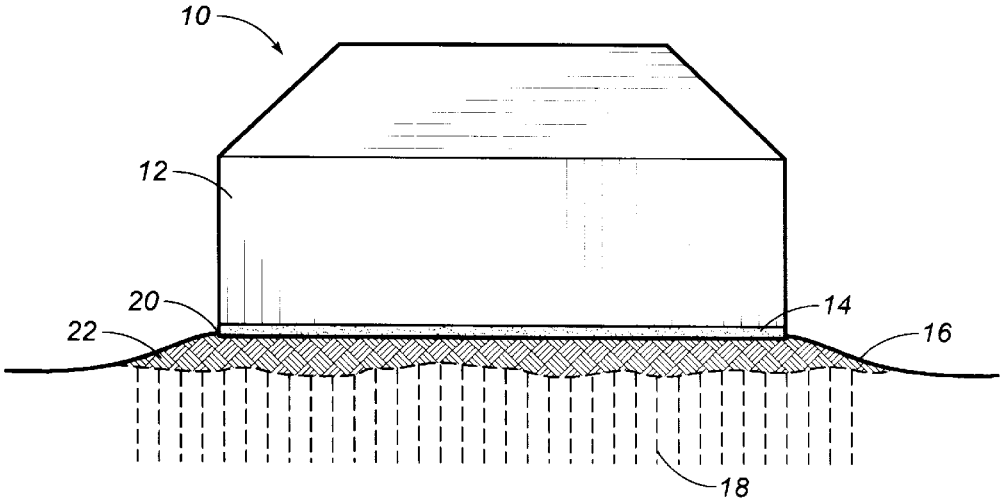
FIG. 1 is a diagrammatic illustration of the method in accordance with the teachings of the present invention.

Referring to FIG. 1, the result of the method of the present invention is illustrated at 10. In FIG. 1, it can be seen that a structure 12 has a foundation 14 supported upon soil 16. An array of voids 18 is formed below the foundation 14 of the structure 12. Additionally, the array of voids 18 extends around the perimeter 20 of the foundation 14. A fill soil 22 is interposed between the bottom of the foundation 14 of structure 12 and the top of the voids 18. Alternatively, in place of the fill soil 22, a plastic sheet can be interposed between the top of the voids 18 and the bottom of the foundation 14.

In FIG. 1, the array of voids 18 is arranged so as to extend vertically into the soil 16. In the preferred embodiment of the present invention, the array of voids 18 is in a geometrically regular pattern. The array of voids 18 extends downwardly into the soil 16 for a depth of expansion potential.

The present invention provides a method for reducing or eliminating the damage from expanding soils by utilizing the in-situ void system 10 either with or without a water or chemical treatment. It is common to analyze site soil conditions and determine the expansion potential of the soil at a particular site. The expansion potential in most soils is dependent on the clay minerals present and the current soil moisture and density conditions. Variations from normal moisture values tend to decrease logarithmically with depth, primarily due to weather. Using this data, it is relatively easy to calculate the amount of volumetric expansion that needs to be accommodated to prevent structural damage. This amount of volumetric expansion will vary from site to site and from year to year depending on soil parameters and current weather conditions. The soil is effectively "locked in" volumetrically at the time of construction due to constraints of the structure. The present invention provides a method for reducing the potential for volumetric expansion either before construction or after construction.

The first step of the present invention is to calculate the anticipated volumetric expansion potential and then to determine the depth of most significant expansion effect. The in-situ void system 10 can then be sized and installed so as to accommodate the required expansion. As shown in FIG. 1, the array of voids 18 is formed by using a standard auger drill to excavate the array of holes 18 in the matrix of soil 16 under or adjacent to the structure 12. The holes 18 should be excavated to the depth of most significant expansion effect. This should be carried out in more or less in an array of regular geometrical pattern so as to achieve the greatest efficiency. The voids 18 created by the drilling should accommodate the anticipated expansion potential. For greatest efficiency, the void size and spacing should be optimally arranged to facilitate the most effective penetration from a water or chemical treatment of the soil matrix.

Figure 2:
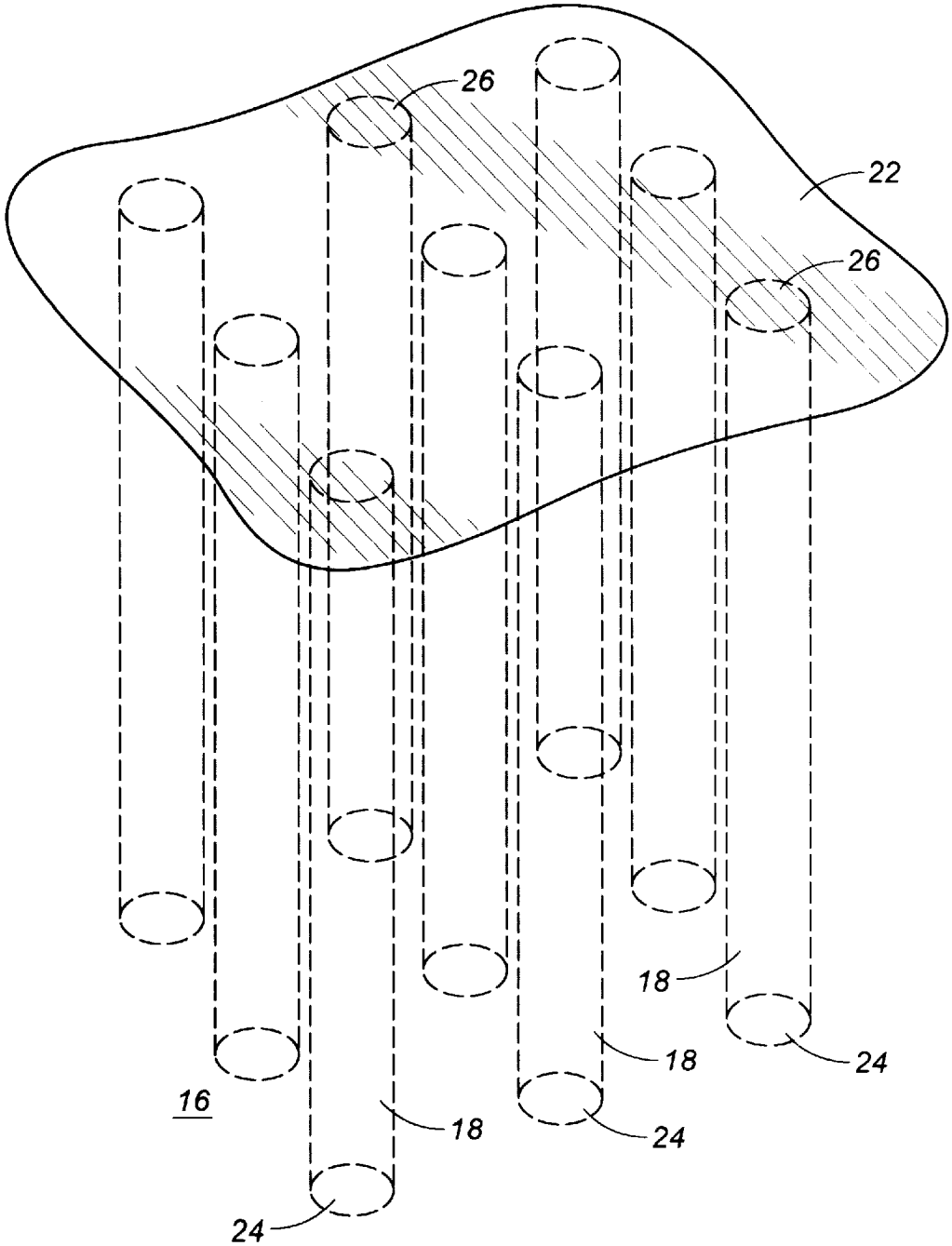
FIG. 2 is a perspective view showing the array of voids formed in the soil as prepared in accordance with the preferred embodiment of the present invention.

FIG. 2 shows the formation of the array of voids 18 within the soil 16. In FIG. 2, it can be seen that the array of voids 18 consists of a plurality of holes extending vertically downwardly into the soil 16. When the holes 18 are formed in the soil 16, a liquid can be introduced into the interior 24 of the respective holes 18. The introduction of a liquid into the holes 18 will cause the soil 16 around the holes 18 to suitably expand and swell. The array of voids 18 can be filled with either water or a mixture of lime and water. The use of lime should be used where the soil 16 is a clay of high plasticity. The mixture of lime and water will react with the clay so as to stabilize the minerals within the clay. Fundamentally, when the holes 18 are filled with water or the mixture of lime and water, the soil 16 adjacent to the holes 18 will absorb the water and expand to the maximum potential. As such, it can be easily gauged whether the holes 18 will accommodate the soil expansion.

In FIG. 2, it can be seen that a covering 22 is placed over the top 26 of the holes 18. The covering 22 can be placed over the top 26 of the holes 18 prior to forming the foundation 14 of structure 12. The covering 22, in the preferred embodiment of the present invention, is a rigid plastic sheet extending over the array of holes 18. The plastic sheet 22 should have a suitable strength so as to withstand the weight of the foundation therein. It is desirable that the plastic sheet 22 prevent the holes 18 from collapsing and to prevent the concrete used for the formation of the foundation 14 from flowing downwardly into the holes 18. Alternatively, the covering 22 can be a fill soil which is interposed between the top 26 of the array of voids 18 and the bottom of the foundation 14. If the fill soil is coarse enough, then the interior of the holes 18 can receive such fill soil to the extent that the fill soil does not prevent the maximum expansion of the soil 16 into the holes 18.

As an example of the present invention, when the site of the structure 12 is calculated to have a potential vertical rise of three inches, this will equate to an expansion of 0.25 cubic feet per square foot. The depth of the most significant effect is within the upper six feet of the soil 16. It is to be noted that some negligible expansion/contraction can occur at deeper levels. To accommodate the 0.25 cubic feet per square foot volumetric expansion, the present invention requires the sizing of an array of in-situ voids to be installed in the matrix of soil 16 beneath the structure 12. In this case, the in-situ voids are calculated to require four inch diameter drilled holes to six feet of depth within soil 16 on one and one-half foot centers in each direction beneath the structure 12 and within about six feet to the exterior of the planned footprint of the structure 12. Preferably, these in-situ voids will then be treated by filling the voids with water or a chemical mixture so as to permeate, expand and stabilize the soil matrix beneath the structure 12. In the event that water treatment does not fully expand the soil matrix 16 so as to close the in-situ voids, or if the in-situ voids are used without a water or chemical treatment, the individual voids should be covered so as to prevent filling with backfill soil or concrete during the construction process.

The method of the present invention can be used for soil volumes beneath planned and existing foundations, for soil volumes adjacent to planned and existing basement walls, for soil volumes adjacent to planned and existing foundation piles or piers, and to any other soil volumes with problematic expansion characteristics. For example, when the structure 12 is an existing structure and the foundation 14 is on soil of high expansion potential, the array of voids 18 can be formed around the perimeter of the foundation 14 in a suitable array so as to prevent soil expansion from affecting the existing structure 12. Although some soil expansion may occur below the foundation 14, in such a situation, the formation of the array of voids 18 around the perimeter of the foundation 14 will serve to minimize the effects of soil expansion and the effects of the soil expansion upon the walls of the foundation 14 or against the walls of the basement associated with structure 12. The present invention can eliminate the need to excavate beneath the foundation 14 for the purpose of installing cardboard void forms or EPS void forms.

An alternative technique to the present invention would be to excavate narrow channels on a grid basis and sizing the voids associated with these narrow channels so as to accommodate the anticipated expansion. The term "array of voids", as used herein, should include both holes and trenches. Similarly, within the concept of the present invention, the grid pattern formed by the array of voids 18 can be a geometrically regular or a geometrically irregular pattern. The geometrically regular pattern identified hereinabove is merely a statement of the preferred embodiment of the present invention. The vertical holes 18 associated with the void system of the present invention can be arrange vertically, horizontally, or at any orientation therebetween.

The foregoing disclosure and description is illustrative and explanatory thereof. Various changes in the details of the described method can be made within the scope of the appended claims without departing from the true spirit of the present invention. The present invention should only be limited by the following claims and their legal equivalents.

We claim:

1. A method of forming an in-situ void system comprising:

determining an expansion potential of soil adjacent to a desired foundation area of a building;

drilling an array of voids to a depth of said expansion potential in an area adjacent to said foundation area so as to accommodate said expansion potential of the soil; and laying a foundation over said array of voids in said desired foundation area subsequent to said step of drilling said array of voids.

2. The method of claim 1, said step of drilling comprising:

drilling said array of holes around a perimeter of the structure.

3. The method of claim 1, further comprising:

introducing a liquid into said array of voids so as to swell the soil.

4. The method of claim 1, further comprising:

covering a top of said array of voids with a covering prior to said step of laying said foundation.

5. The method of claim 4, said step of covering comprising:

placing a rigid plastic sheet over a top of said array of voids, said plastic sheet having a strength suitable for withstanding a weight of said foundation.

6. The method of claim 4, said step of covering comprising:

covering said array of voids with a fill soil, said fill soil interposed between the top of said array of voids and a bottom of said foundation.

7. A method of constructing a foundation so as to minimize effects of soil expansion comprising:

determining an expansion potential of the soil adjacent to the foundation;

forming an array of voids in the soil adjacent to the foundation, said array of voids extending below a desired depth of the foundation;

covering a top of said array of voids; and forming the foundation directly on top of said array of voids, said array of voids being sized to accommodate a potential of the soil expansion adjacent to the foundation.

8. The method of claim 7, further comprising:

introducing a liquid into the formed array of voids prior to forming the foundation.

* * * * *